US011107450B2

(12) United States Patent
Chickneas

(10) Patent No.: US 11,107,450 B2
(45) Date of Patent: Aug. 31, 2021

(54) PEDALBOARD FOR HOUSING MUSICAL EFFECT COMPONENTS

(71) Applicant: Jonathan Chickneas, Oakland, CA (US)

(72) Inventor: Jonathan Chickneas, Oakland, CA (US)

( * ) Notice: Subject to any disclaimer, the term of this patent is extended or adjusted under 35 U.S.C. 154(b) by 0 days.

(21) Appl. No.: 16/861,061

(22) Filed: Apr. 28, 2020

(65) Prior Publication Data

US 2020/0388260 A1 Dec. 10, 2020

Related U.S. Application Data

(60) Provisional application No. 62/858,232, filed on Jun. 6, 2019.

(51) Int. Cl.

| | |
|---|---|
| ***G10H 1/34*** | (2006.01) |
| ***H04H 60/04*** | (2008.01) |
| ***H04H 60/05*** | (2008.01) |

(52) U.S. Cl.

CPC ..... *G10H 1/348* (2013.01); *H04H 60/04* (2013.01); *H04H 60/05* (2013.01); *G10H 2210/155* (2013.01); *G10H 2230/371* (2013.01)

(58) Field of Classification Search

CPC ..... G10H 1/348; G10H 2210/155; G10H 2230/371; H04H 60/05; H04H 60/04

USPC ..... 84/653

See application file for complete search history.

(56) References Cited

U.S. PATENT DOCUMENTS

| | | | | |
|---|---|---|---|---|
| 6,215,055 | B1 * | 4/2001 | Saravis | G10H 1/348 84/422.1 |
| 6,459,023 | B1 * | 10/2002 | Chandler | G10H 1/32 84/177 |
| 6,538,185 | B1 * | 3/2003 | Stratton | G10H 1/32 84/422.1 |
| 8,119,900 | B2 * | 2/2012 | Skillings | G10H 1/0058 84/742 |
| 8,309,835 | B2 * | 11/2012 | Ludwig | G10H 1/32 84/615 |
| 8,614,385 | B2 * | 12/2013 | McKinney | G10H 1/348 84/453 |
| 9,659,553 | B1 * | 5/2017 | Lawrence | G10H 1/348 |
| 9,800,357 | B2 * | 10/2017 | Tillman | H04H 60/05 |
| 10,170,092 | B2 * | 1/2019 | Mayo | G10H 1/0008 |
| 10,380,984 | B1 * | 8/2019 | Calder | G10H 1/32 |
| 10,395,631 | B1 * | 8/2019 | Boxberger | G10H 1/0555 |
| 10,515,617 | B2 * | 12/2019 | Canivell Grifols | G10G 5/00 |

(Continued)

*Primary Examiner* — Christina M Schreiber

(74) *Attorney, Agent, or Firm* — Perkins Coie LLP; Patrick Morris; Jacob D. Gober

(57) ABSTRACT

The disclosed embodiments relate to a pedalboard configured to house a musical effect component. A musical effect component housing may be configured to house a musical effect component and be disposed in a cavity of the pedalboard without the use of an adhesive fastener. The musical effect component housing may include a first plate, a second plate, and standoffs connecting the first plate and the second plate. A musical effect component may be disposed between the first plate and second plate to secure the musical effect component. The first plate may include an aperture formed within the first plate configured to dispose a portion of a musical effect component and a rail formed on both a first end and a second end of the first plate configured to engage the musical effect component housing with the pedalboard.

20 Claims, 10 Drawing Sheets

(56) References Cited

U.S. PATENT DOCUMENTS

| | | | | |
|---|---|---|---|---|
| 10,565,971 | B2 * | 2/2020 | Wilfer | G10H 1/348 |
| 10,706,828 | B2 * | 7/2020 | Christian | G10H 3/186 |
| 10,832,644 | B2 * | 11/2020 | Fiden | G10H 1/348 |
| 10,867,590 | B1 * | 12/2020 | Miller | G10H 1/0091 |
| 10,923,090 | B1 * | 2/2021 | Boxberger | G10H 1/348 |
| 2008/0118088 | A1 * | 5/2008 | Ketterer | H04R 5/02 381/119 |
| 2013/0327201 | A1 * | 12/2013 | Urry | G10H 1/348 84/626 |
| 2014/0131543 | A1 * | 5/2014 | Goto | F16M 11/043 248/429 |
| 2019/0103086 | A1 * | 4/2019 | Christian | H01M 10/482 |
| 2019/0237053 | A1 * | 8/2019 | Canivell Grifols | G10H 1/32 |
| 2020/0027433 | A1 * | 1/2020 | Wilfer | G10G 5/00 |
| 2020/0251078 | A1 * | 8/2020 | Stringham | G10H 1/348 |
| 2020/0372880 | A1 * | 11/2020 | Stanley | G10G 7/00 |
| 2020/0388260 | A1 * | 12/2020 | Chickneas | G10H 1/348 |

* cited by examiner

PEDALBOARD FOR HOUSING MUSICAL EFFECT COMPONENTS

CROSS-REFERENCE TO RELATED APPLICATION(S)

The present application claims priority to U.S. Provisional Patent Application No. 62/858,232, titled "PEDALBOARD FOR HOUSING MUSICAL EFFECT COMPONENTS," and filed Jun. 6, 2019, which is incorporated by reference in its entirety hereto.

TECHNICAL FIELD

The disclosed teachings generally relate to musical effect components. The disclosed teachings more particularly relate to a pedalboard to house one or more musical effect components.

BACKGROUND

Musicians play various musical instruments to achieve various sounds. Many musical instruments may be connected to additional musical effect components to modify the sounds of the musical instrument or add an effect to the sound. For example, a guitarist may connect a guitar to one or more electronic musical effect components (e.g., an equalizer) that alters the sounds emanating from the guitar or a speaker connected to the guitar. Examples of such electronic musical effect components for a musical instrument may include an equalizer, a frequency modifier (or "wah-wah"), a filter, a compressor, a gain effect, etc.

Because musicians primarily use their hands to play many musical instruments (e.g., a guitar), electronic musical effect components (or pedals) may be configured as pedals operated by the feet of the musician. In order to utilize multiple pedals, a musician may configure a pedalboard to house and connect multiple pedals to achieve a desired sound/effect. A musician generally can arrange and rearrange a plurality of combinations of pedals in the pedalboard based on the preference of the musician and the desired sound/effect.

Figure 1:
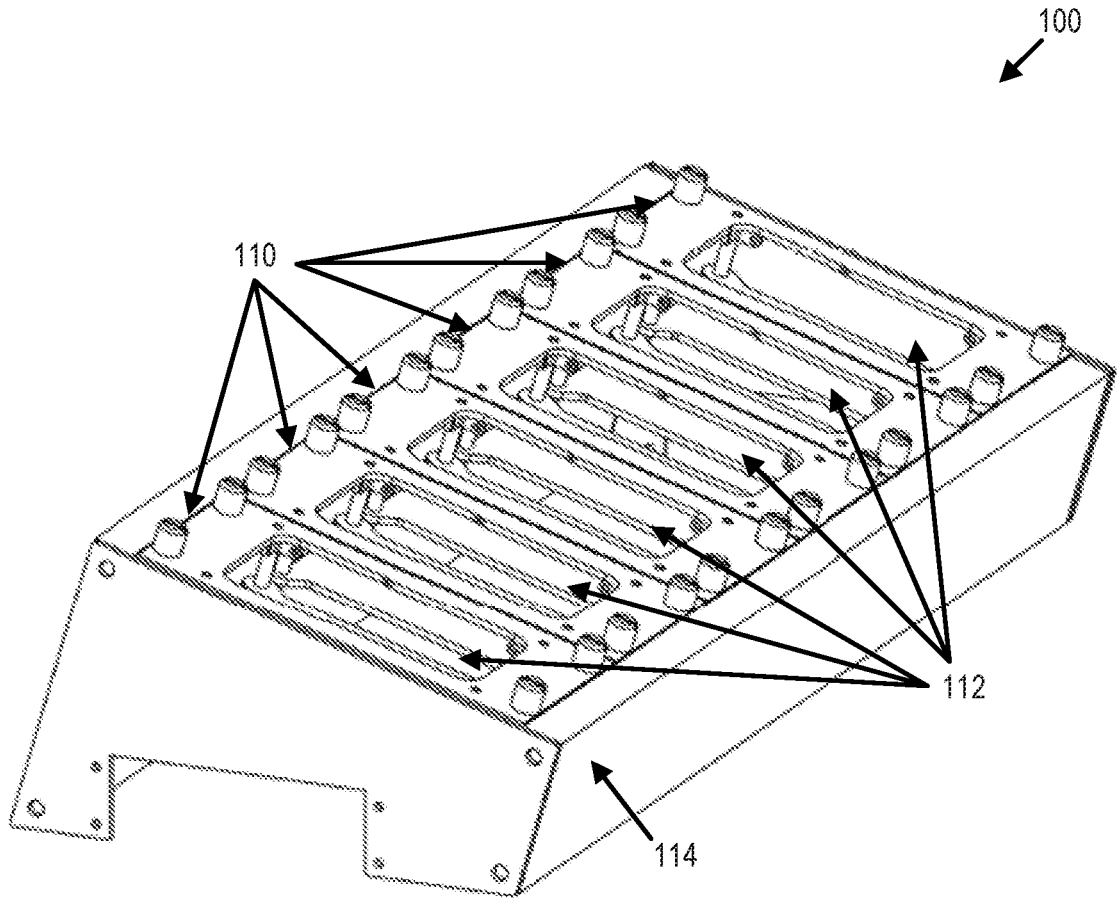
FIG. 1 illustrates a perspective view of a pedalboard, in accordance with various embodiments.

The drawings and tables depict various embodiments for illustration only. Those skilled in the art will recognize that alternative embodiments may be employed without departing from the principles of the technology. Accordingly, while specific embodiments are shown in the drawings, the technology is amenable to various modifications.

DETAILED DESCRIPTION

Musicians may primarily use their hands to play various musical instruments (e.g., a guitar). Additionally, musicians may want to alter/modify the sounds emitted from a musical instrument using one or more electronic musical effect components (or "pedals"). Examples of such electronic musical effect components for a musical instrument may include an equalizer, a frequency modifier (or "wah-wah"), a filter, a compressor, a gain effect, etc.

In order to utilize multiple pedals, a musician may configure a pedalboard to house and connect multiple pedals to achieve a desired sound/effect. A musician generally can arrange and rearrange a plurality of combinations of pedals in the pedalboard based on the preference of the musician and the desired sound/effect.

In many cases, to secure a pedal to the pedalboard, the pedal may be adhered to the pedalboard using an adhesive fastener. Examples of adhesive fasteners may include hook and loop fasteners, a double-sided tape, adhesives, etc. The adhesive fasteners may cover or contact sensitive parts of the pedals, such as access screws, dip switch settings, buttons, dials, serial numbers, etc. In many cases, the adhesive fastener may limit access to parts of a pedal and may lower the overall usefulness of the pedal.

In many cases, a musician may use various pedals to achieve a musical effect. In using various pedals in various sequences to achieve different resulting sounds/effects, pedals may be periodically removed and added to the pedalboard. However, in many cases, the adhesives fastening the pedal to the pedalboard may not easily be removable from either the pedalboard or the pedal. Accordingly, removal of the pedals may be difficult, and specific types of adhesive fasteners (e.g., tape, adhesives on hook-and-loop fasteners) may leave a residue or scratches to a pedal, which may lower the aesthetics, value, and quality of the pedal and pedalboard.

Further, many pedalboards include a flat surface where pedals are affixed to the pedalboard. In many cases, pedals include varying dimensions for various reasons (e.g., made by different manufacturers, different type of pedal). Accordingly, the pedals on the pedalboard may be of varying height when fastened to the pedalboard. This may decrease the ability to operate and utilize the pedals in the pedalboard, as access to some pedals may be at least partially obstructed by the arrangement of various pedals. For example, larger pedals can obstruct access to smaller pedals, where a foot of a musician may be unable to access the smaller pedals.

Additionally, the flat surface of many pedalboards may expose cables connecting the pedals to other components (e.g., a speaker, power source, an audio signal connection). However, exposed cables are susceptible to damage and are less visually appealing. Further, in many cases, the cables for the pedals may be woven through the surface of the pedalboard for cable management, which may be time consuming to assemble/modify and difficult to replace pedals in the pedalboard.

System Overview

The present embodiments relate to a pedalboard with a removable pedal housing to secure one or more musical effect components (or pedals) in the pedalboard. The pedalboard may be configured to house one or more pedal housings, and each pedal housing may house/secure a pedal. Each pedal housing may include multiple plates and a fastening mechanism to secure the pedal within the pedal housing. A fastening mechanism may include a standoff serving as a spacer between the plates and a fastener (e.g. screws) engaging the standoff to the plates. A pedalboard that utilizes the pedal housing to secure a pedal in the pedalboard may not require the use of an adhesive fastener (e.g., hook-and-loop fasteners, tape), as the pedal is secured without the use of an additional fastener. Further, the pedalboard and pedal housing may protect the pedals from damage.

The height of the plates and standoffs connecting the plates (collectively referred to as a pedal housing) may match or be substantially similar to the height of the pedal. The standoffs may be located between a top plate (e.g., a first plate) and a bottom plate (e.g., a second plate), allowing for the pedal housing to secure pedals of varying dimensions. Accordingly, pedals secured in pedal housings may be disposed within a cavity of a pedalboard with a similar height. In other words, the height of the top plate of each pedal housing in the pedalboard may be similar or equal.

Further, the pedalboard as described herein may provide an adhesive-free design to secure pedals and to obscure the visibility to signal and power cables/jacks for each pedal. The cables for the pedals may be accessed from an underside of the pedalboard. The pedal housing, when engaged to the pedalboard, may prevent exposure of cables of the pedal. This design may create a clean appearance that protects the cables/jacks from damage.

The embodiments set forth below represent the necessary information to enable those skilled in the art to practice the embodiments and illustrate the best mode of practicing the embodiments. Upon reading the following description in light of the accompanying figures, those skilled in the art will understand the concepts of the disclosure and will recognize applications of these concepts that are not particularly addressed herein. These concepts and applications fall within the scope of the disclosure and the accompanying claims.

Terminology

The purpose of terminology used herein is only for describing embodiments and is not intended to limit the scope of the disclosure. Where context permits, words using the singular or plural form may also include the plural or singular form, respectively.

References to "an embodiment" or "one embodiment" means that the particular feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the words "comprise" and "comprising" are to be construed in an inclusive sense rather than an exclusive or exhaustive sense (i.e., in the sense of "including but not limited to").

The term "based on" is also to be construed in an inclusive sense rather than an exclusive or exhaustive sense. Thus, unless otherwise noted, the term "based on" is intended to mean "based at least in part on."

When used in reference to a list of multiple items, the word "or" is intended to cover all of the following interpretations: any of the items in the list, all of the items in the list, and any combination of items in the list.

The sequences of steps performed in any of the processes described herein are exemplary. However, unless contrary to physical possibility, the steps may be performed in various sequences and combinations. For example, steps could be added to, or removed from, the processes described herein. Similarly, steps could be replaced or reordered. Thus, descriptions of any processes are intended to be open-ended.

Pedalboard Overview

FIG. 1 illustrates a perspective view of a pedalboard 100, in accordance with various embodiments. As shown in FIG. 1, the pedalboard 100 may include multiple pedal housings 110 that are configured to house and secure pedals to the pedalboard 100. Each pedal housing 110 can include a cavity 112 formed therein configured to house a pedal. Disposing and securing a pedal inside the pedal housing 110 is discussed in greater detail with respect to FIGS. 4A-4D.

A pedal may be disposed at least partially within a pedal housing 110. Each pedal, when disposed in the housing 110, may expose a portion of the pedal. In some embodiments, various buttons, dials, displays, etc. included in each pedal may be exposed from the pedal housing 110 and the pedalboard 100.

Each pedal housing 110 may be removably engaged to the pedalboard 100. In some embodiments, a pedal housing 110 may be removably engaged to a frame 114 of the pedalboard 100. Each pedal housing 110 may be housed in a cavity formed in the pedalboard 100, where the pedal housing 110 may be engaged to a frame 114 of the pedalboard 100.

Each pedal housing 110 may be of a uniform height when secured in the pedalboard 100. The pedal housing 110 may secure and surround pedals of varying size. Accordingly, each pedal housing 110 may be secured within the pedalboard 100 with a height that is uniform among multiple pedal housings 110 secured in the pedal board 100.

In some embodiments, the pedal housing 110 may be fastened into the pedalboard using a fastener (e.g., a screw). The number of pedals and pedal housings 110 that can be included in pedalboard 100 may depend on the dimensions of both the pedalboard 100 and the pedal housing 110.

In some embodiments, a pedalboard to house at least one musical effect component may include a pedalboard frame. The pedalboard frame can include at least two frame portions, each of the at least two frame portions including an engagement rail, the pedalboard frame forming a cavity between the at least two frame portions.

The pedalboard can also include a musical effect component housing. The musical effect component housing can include a first plate forming an aperture therein configured to expose a portion of a musical effect component, wherein the first plate is configured to engage to the engagement rails of the at least two frame portions of the pedalboard frame. The musical effect component housing can also include a second plate disposed subjacent to the first plate, wherein the musical effect component is configured to be disposed between the first plate and the second plate. The musical effect component housing can also include a series of fasteners extending between the first plate and the second plate to connect the first plate and the second plate, the first plate and the second plate configured to be disposed within the cavity between the at least two frame portions formed in the pedalboard frame.

In some embodiments, the first plate includes a length and a width that is greater than a length and a width of the second plate. In some embodiments, the at least two frame portions include a first frame portion and a second frame portion, the first frame portion including a length less than a length of the second frame portion, wherein the musical effect component housing is disposed on the pedalboard frame at an angle based on the lengths of the at least two frame portions.

In some embodiments, the musical effect component housing can include a set of bumpers disposed around each of the series of fasteners, each bumper configured to engage with a portion of the musical effect component.

In some embodiments, the pedalboard can include a series of musical effect component housings disposed along the engagement rails on the at least two frame portions of the pedalboard frame, each of the series of musical effect component housings disposed adjacent to one another.

In some embodiments, the pedalboard can include four securement posts disposed on a separate corner of the first plate, each securement post fastening a portion of the first plate to the engagement rails.

In some embodiments, the series of fasteners include varying lengths to accommodate securing varying sized musical effect components between the first plate and the second plate.

Figure 2:
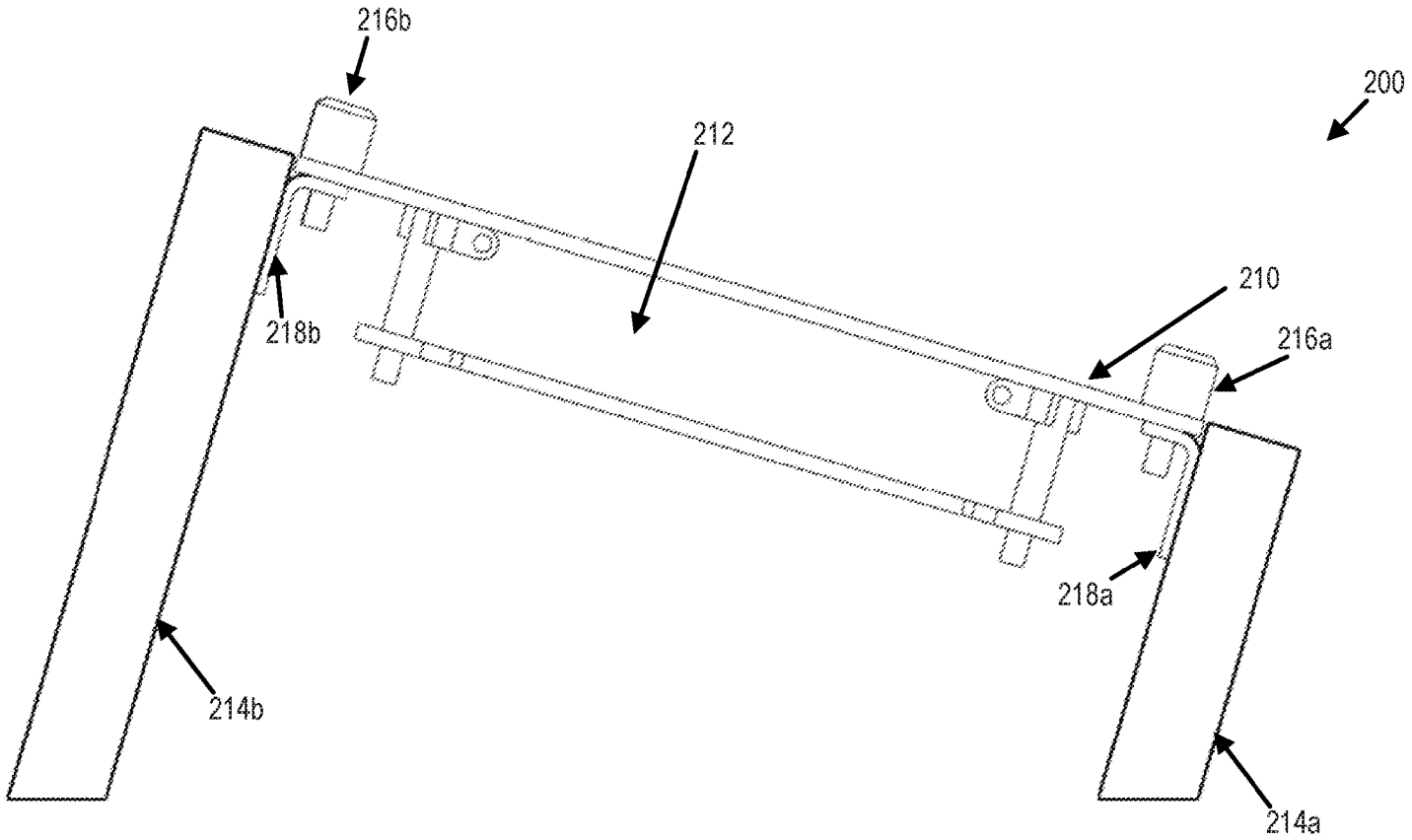
FIG. 2 is a section view of a pedalboard, in accordance with various embodiments.

FIG. 2 is a section view of a pedalboard 200, in accordance with various embodiments. As shown in FIG. 2, a pedal housing 210 can be engaged to the pedalboard 200. The pedal housing 210 can be secured to the pedalboard 200 via securing posts 216*a-b*. Particularly, securing posts 216*a-b* can include a securing mechanism to secure a top plate of the pedal housing 210 to engagement rails 218*a-b* of the pedalboard 200.

The pedalboard 200 can include multiple frame portions 214*a-b*. The frame portions 214*a-b* can include a frame of the pedalboard 200 that forms the overall shape of the pedalboard 200. For example, a length of a first portion 214*a* can be less than a length of a second portion 214*b*, thereby causing an angle of the pedalboard 200. The angle of the pedalboard 200 can modify an angle at which the pedals are disposed in the pedal housing 210 via cavity 212. For example, a downward angle of the pedal housing 210 can allow for a pedal disposed in the cavity 212 to be angled toward a user above the pedalboard 200 to better view and access the pedal.

Figure 3:
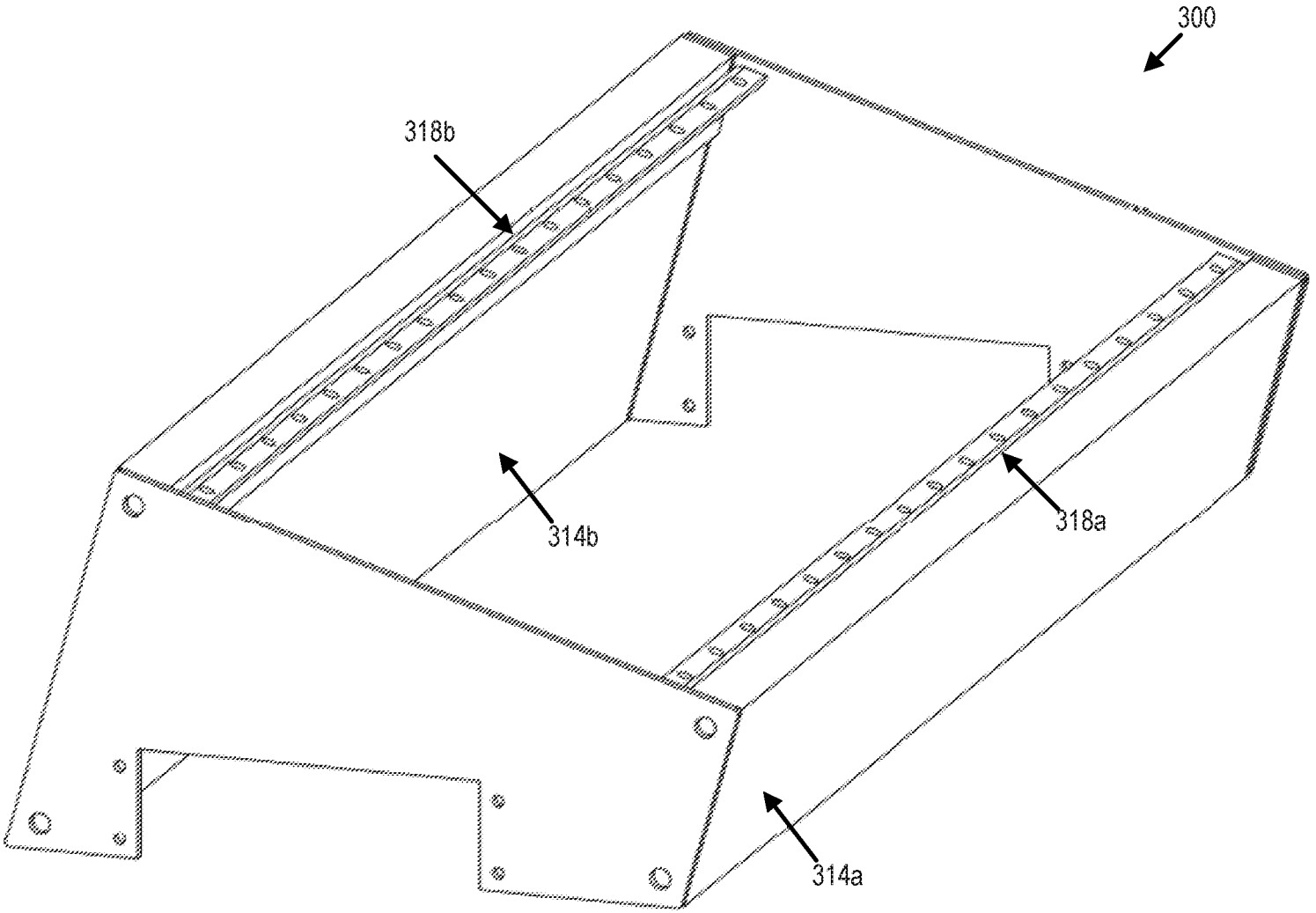
FIG. 3 is a perspective view of a frame of a pedalboard, in accordance with various embodiments.

FIG. 3 is a perspective view of a frame of a pedalboard 300, in accordance with various embodiments. As shown in FIG. 3, the pedalboard 300 can include multiple frame portions 314*a-b*. The frame portions 314*a-b* can include engagement rails 318*a-b* that allow for secure and accessible connection between the pedalboard and a pedal housing. The pedalboard 300 can include a length capable of housing multiple pedal housings.

The engagement rails 318*a-b* can be disposed on each frame portion 314*a-b* and can allow for a pedal housing to mount to a pedal board. The engagement rails 318*a-b* may be disposed on a pedalboard via a suitable fastening technique. Engagement rails 318*a-b* may be engaged to opposing ends of the top plate of a pedal housing. In some embodiments, fasteners (e.g., screw, clips, magnets) may fasten the engagement rails 318*a-b* to a pedal housing.

The engagement rails 318*a-b* may facilitate the pedal housing to removably engage to the pedalboard. For example, the engagement rails 318*a-b* may engage to a surface of the pedalboard secures the pedal housing to the pedalboard. In some embodiments, the cables/jacks may be hidden or obscured from view by engagement rails 318*a-b* and the pedal housing. The top plate and engagement rails 318*a-b* may obscure or hide various components of the pedal from view.

FIGS. 4A-4D illustrate various views of an example pedal housing. As noted above, a pedal housing 400*a-d* is configured to secure a pedal and to engage with a pedalboard.

Figure 4A:
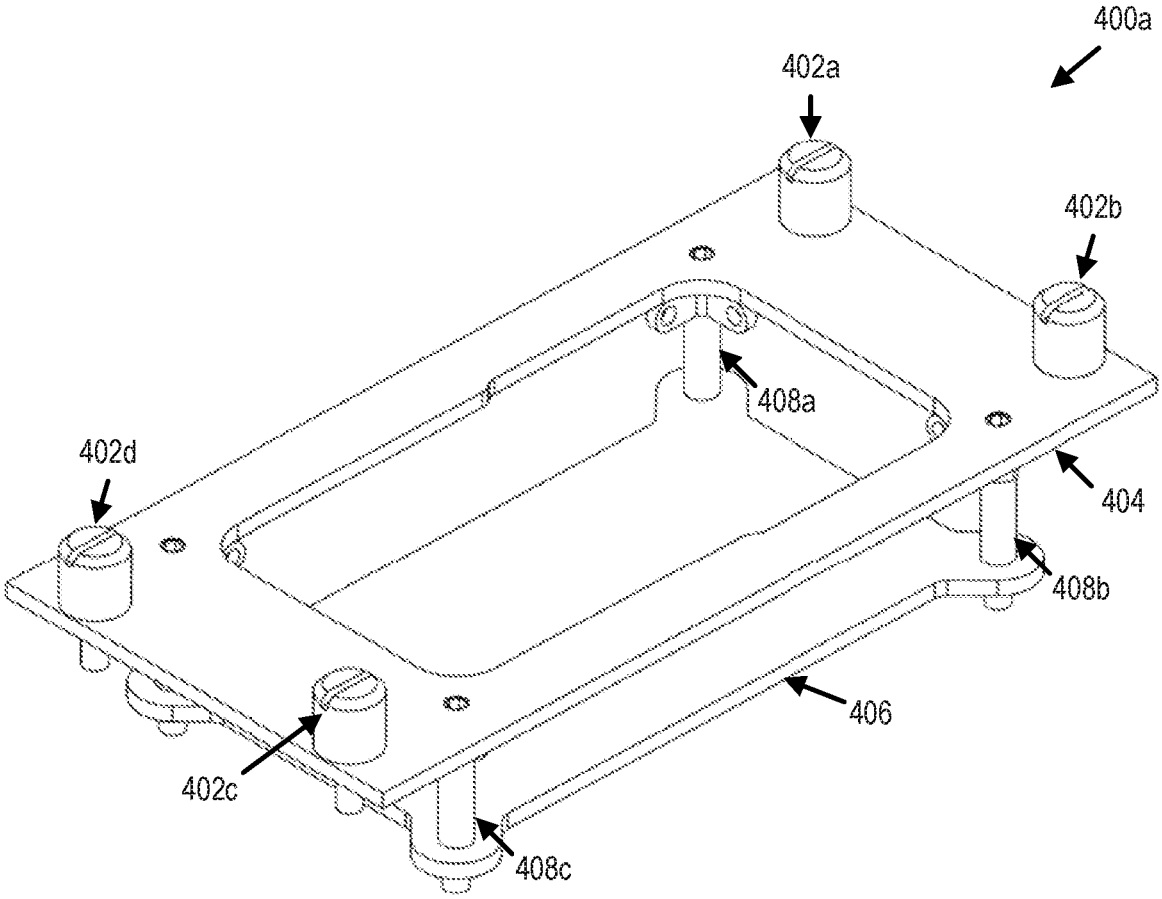
FIG. 4A is a perspective view of a pedal housing, in accordance with various embodiments.

FIG. 4A is a perspective view of a pedal housing 400*a*, in accordance with various embodiments. The pedal housing 400*a* may include a top plate 404 and a bottom plate 406. The top plate 404 may be engaged to bottom plate 406 via a series of fasteners 408*a-b*. The fasteners 408*a-d* (or "standoffs") may be of variable length to secure pedals of various sizes. The top plate 404 and bottom plate 406 may be disposed on either side of a pedal. The top plate 404 may be disposed above or superjacent to the bottom plate 406. The top plate 404 and bottom plate 406 may include a metal, a metal alloy, or a plastic material.

The top plate 404 may include a width and length greater than that of the bottom plate 406. The top plate 404 may be larger than bottom plate 406 so as to allow for the top plate to engage with the pedalboard via securing posts 402*a-d*. The bottom plate 406 may include a tab in each corner that extends beyond the case of the pedal. In some embodiments, the bottom plate 406 can include an aperture disposed in the plate so as to allow for exposure of a portion of the pedal from the bottom of the pedal housing 400*a*. The top plate 404 may include a cutout with slightly larger dimensions of the top of a given pedal. This may allow for the top plate 404 to be placed over the pedal while exposing a portion of a pedal.

Each fastener 408*a-c* may include a fastener (e.g., a screw) that is configured to connect the top plate 404 and bottom plate 406. The fasteners 408*a-c* may be cylindrical in shape. In some embodiments, the fasteners 408*a-c* may include standoffs that are hollow and configured to receive one or two screws disposed within the hollow portion of the standoff to secure the top plate 404 and bottom plate 406. The standoff 408*a-c* may include a screw run through the top plate 404 and fastened to the bottom plate 406 with a nut. In some embodiments, the fastener 408*a-c* a female threading, where the female threading is configured to engage with a screw, securing the top plate 404 and bottom plate 406.

Figure 4B:
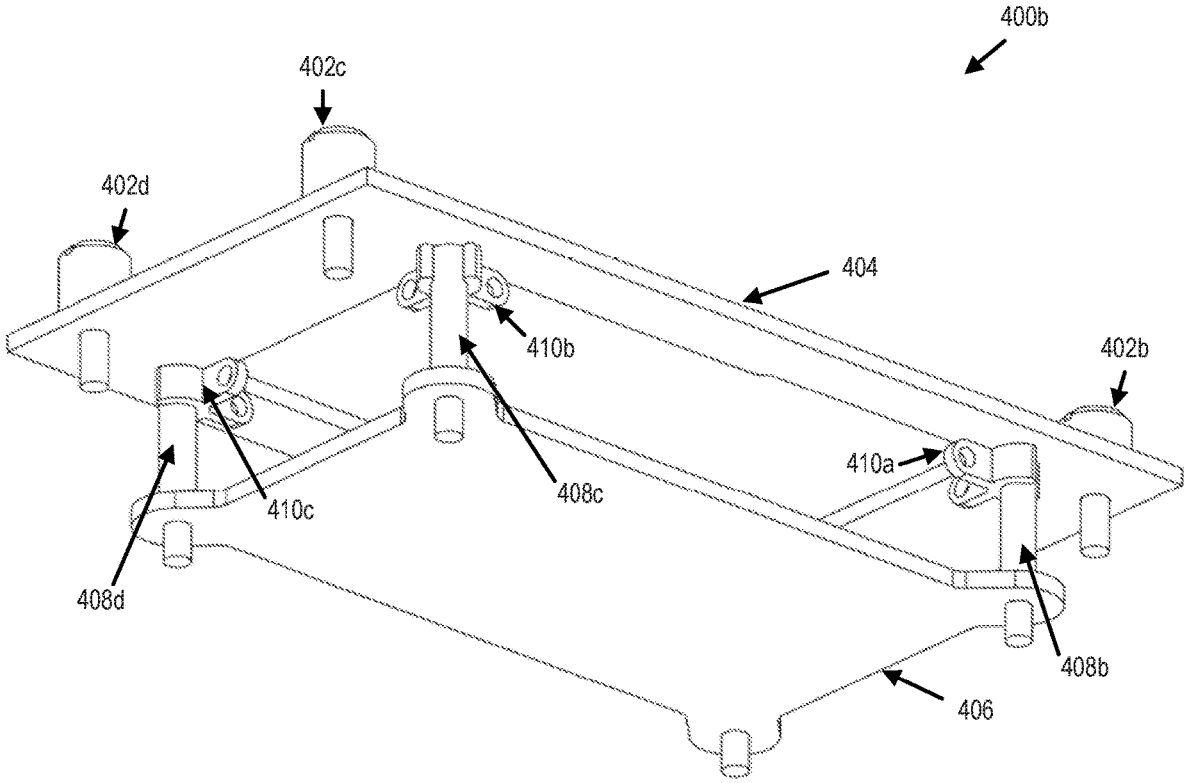
FIG. 4B is a bottom view of a pedal housing, in accordance with various embodiments.

FIG. 4B is a bottom view of a pedal housing 400*b*, in accordance with various embodiments. The pedal housing 400*b* can include a series of bumpers 410*a-c*. Each bumper 410*a-c* can engage to a fastener 408*a-c* and is configured to engage with a portion of a pedal when a pedal is disposed in the cavity of the pedal housing 400*b*. In operation, the bumpers 410*a-c* may secure the pedal within the pedal housing and prevent movement of the pedal when secured in pedal housing. The bumpers 410*a-c* may include a flexible material, such as rubber, foam, etc. The bumper may include a plastic anchor that clips onto the standoff, and a soft rubber bumper that presses against the pedal on multiple sides. The bumper is discussed in greater detail with respect to FIGS. 5A-B.

In some embodiments, the pedal may be an unusual size. In these embodiments, a custom standoff may be implemented in the pedal housing. The custom standoff may include a metal spacer screwed into the top plate 404 and bottom plate 406 by screwing the standoff to the plates. The custom standoffs may be of varying sizes to incorporate a pitch into the pedal housing.

Figure 4C:
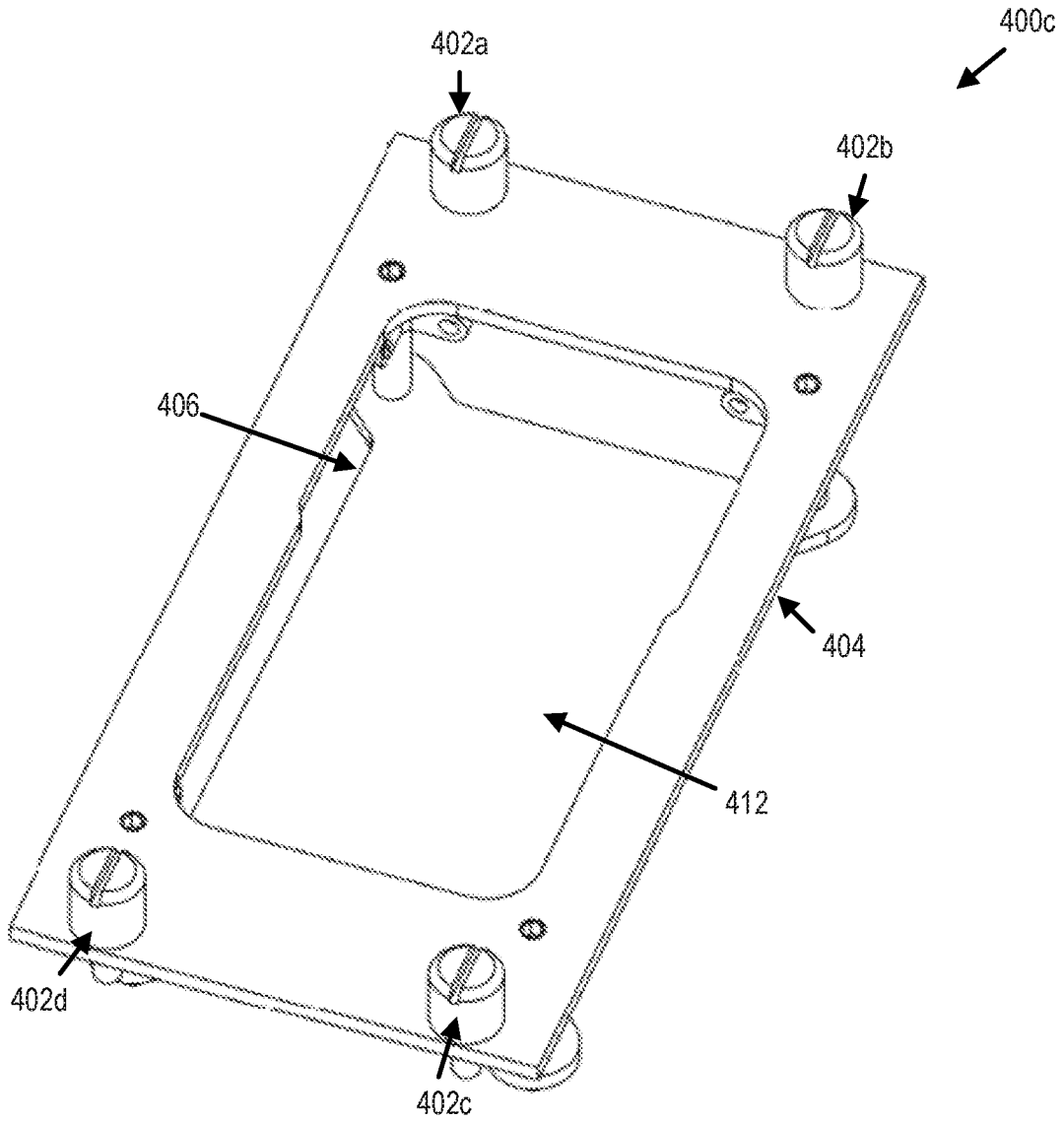
FIG. 4C is a top view of a pedal housing, in accordance with various embodiments.

FIG. 4C is a top view of a pedal housing 400*c*, in accordance with various embodiments. As shown in FIG. 4C, a cavity 412 can be formed between top plate 404 and bottom plate 406. The cavity 412 can house a pedal. The top plate 404 can include four securing posts 402*a-d* configured to secure the top plate 404 to a pedalboard.

Figure 4D:
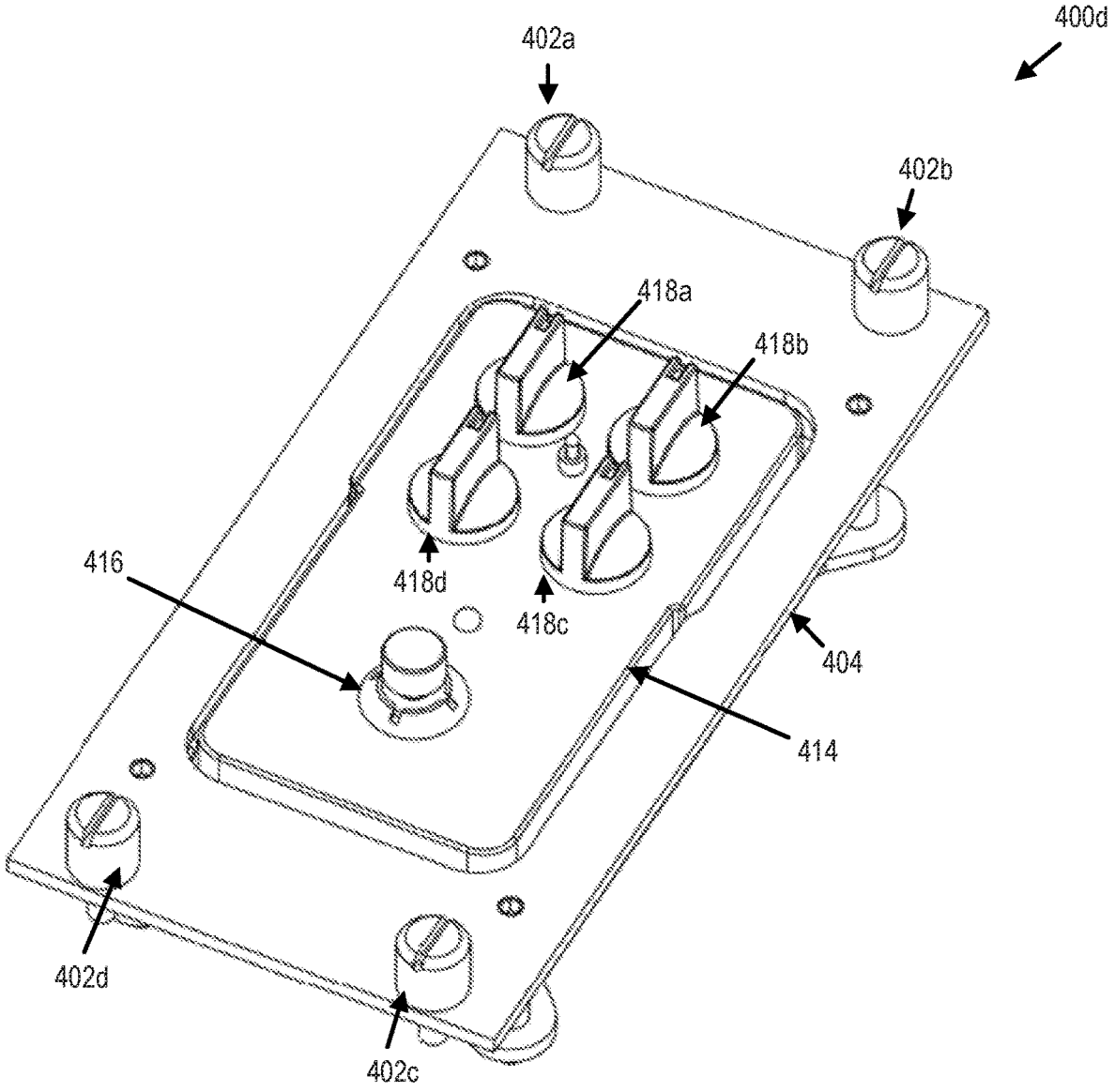
FIG. 4D is a top view of a pedal housing containing a pedal, in accordance with various embodiments.

FIG. 4D is a top view of a pedal housing 400*d* containing a pedal 414, in accordance with various embodiments. As shown in FIG. 4D, the pedal housing 400*d* can house a pedal 414. The pedal 414 can be disposed between the top plate 404 and bottom plate 406. The top plate 404 can include an opening that allows for a portion of the pedal to be exposed and visible by an operator. The exposed portion of a pedal 414 can include various displays, switches, etc., that allows for modification of settings at the pedal. For instance, a switch 416 and/or dials 418*a-d* can be exposed through the aperture of the top plate 404.

Figure 5A:
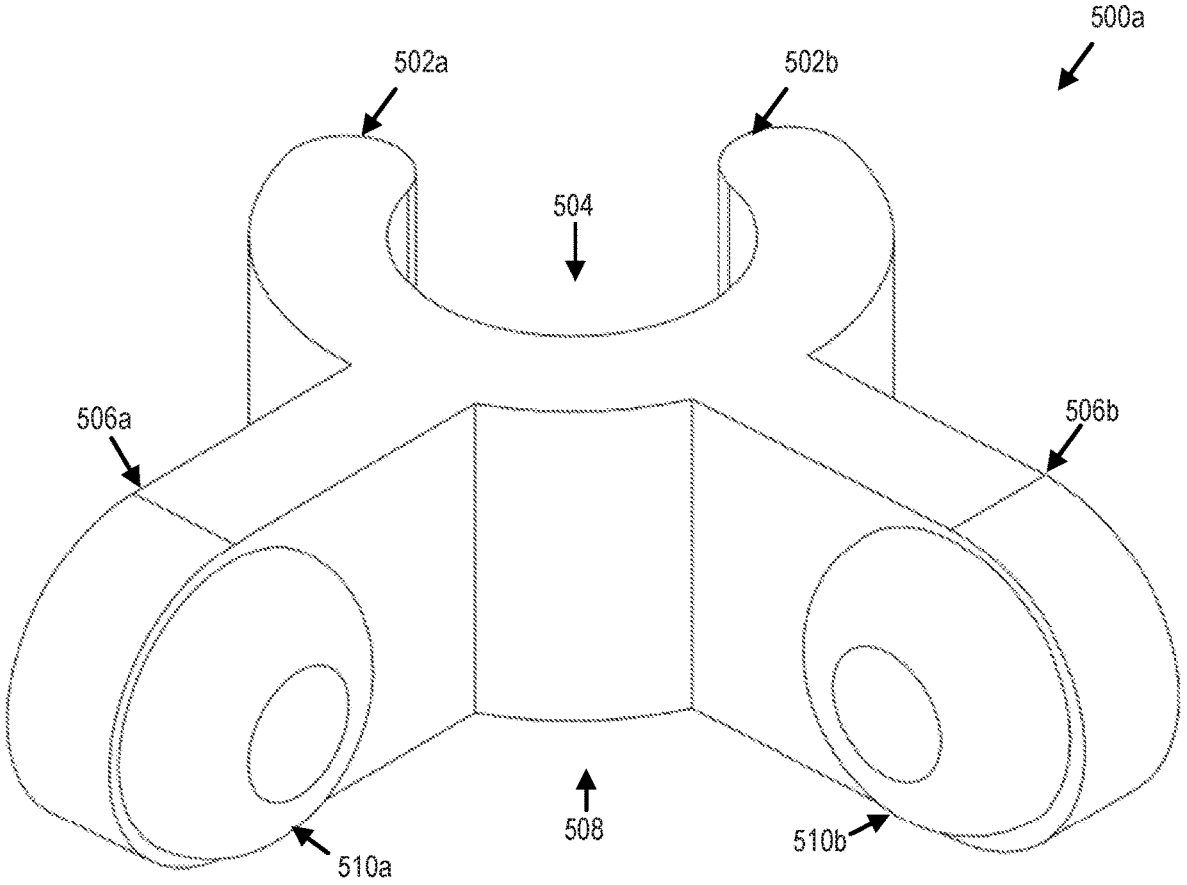
FIG. 5A is a front view of a bumper, in accordance with various embodiments.
Figure 5B:
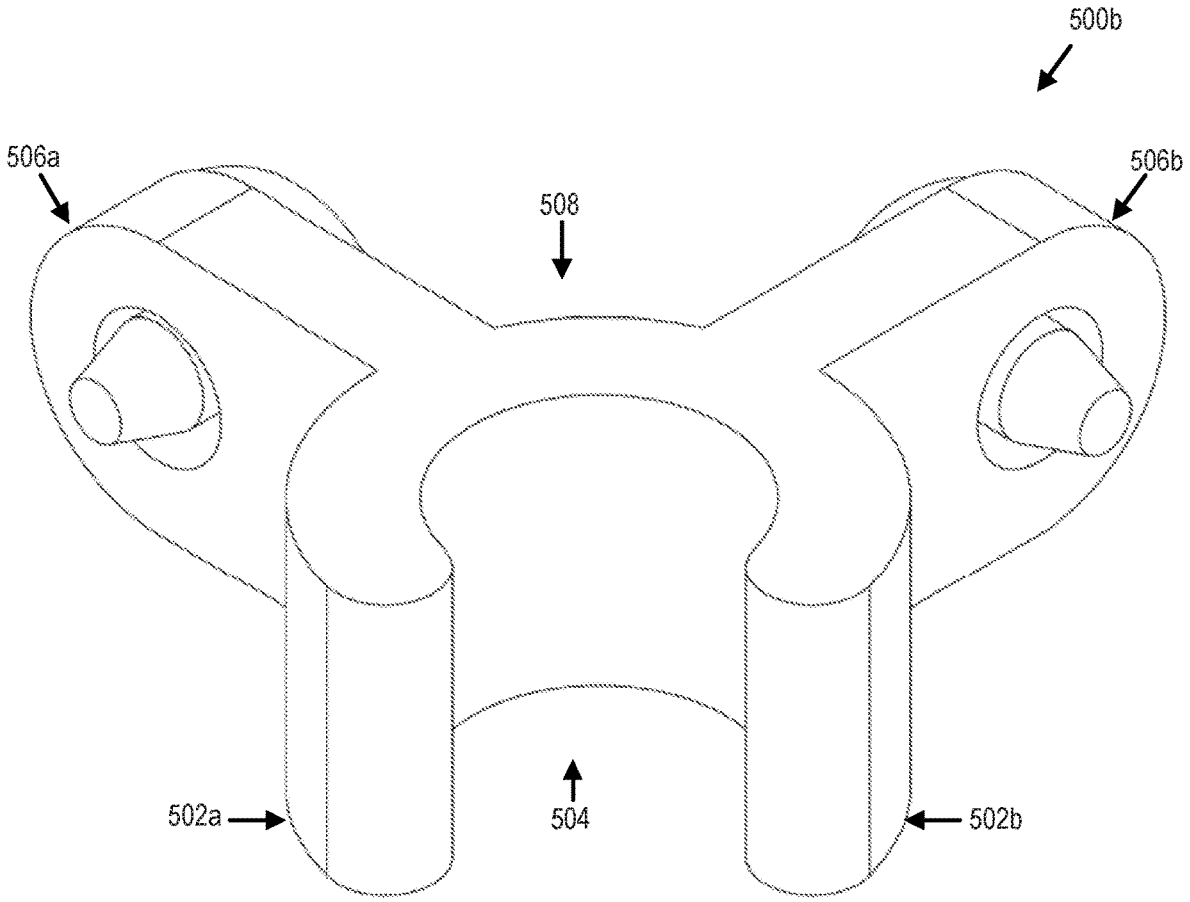
FIG. 5B is a rear view of a bumper, in accordance with various embodiments.

FIG. 5A is a front view of a bumper 500*a*, in accordance with various embodiments. FIG. 5B is a rear view of a bumper 500*b*, in accordance with various embodiments. As noted above, the bumper 500*a-b* can be located between a pedal and a fastener of a pedal housing. The bumper 500*a-b* can include a first portion with prongs 502*a-b* configured to be located around a fastener (e.g., fastener 408*a-d*) and a cavity 504 where the fastener is configured to be received. The bumper 500*a-b* can also include a second portion with prongs 506*a-b* configured to engage with a pedal. The opening 508 can be configured to receive a part of a pedal. The bumper 500*a-b* can include ends 510*a-b* to engage to the pedal without incurring damage to the pedal. The pedal can be secured in place by the bumpers 500*a-b* via ends 510*a-b* by applying pressure to the pedal. The bumpers 500*a-b* can include a soft material (e.g., rubber) so as to not damage a pedal when engaged to the pedal.

Figure 6:
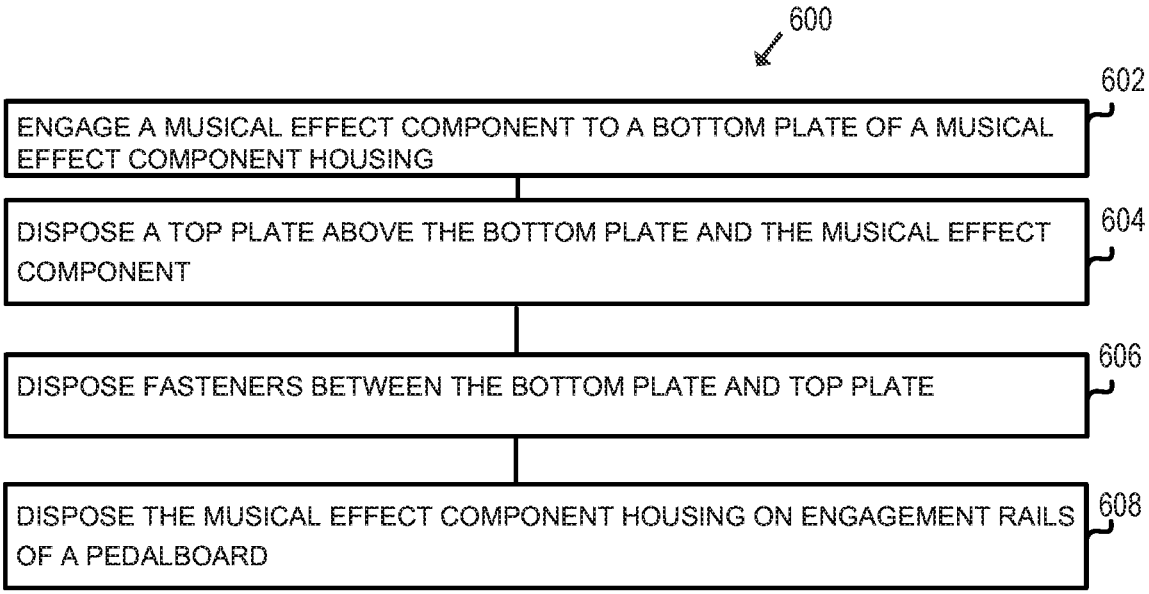
FIG. 6 illustrates a flow diagram of a method to secure a musical effect component to a pedalboard, in accordance with various embodiments.

FIG. 6 illustrates a flow diagram of a method 600 to secure a musical effect component to a pedalboard, in accordance with various embodiments. The method may include engaging a musical effect component (or pedal) to a bottom plate of a pedal housing (block 602). A musical effect component may include an electronic pedal configured to alter a sound emanating from a musical instrument.

The method may include disposing a top plate on the pedal and above the bottom plate (block 604). The top plate may be superjacent to or above the bottom plate, where each plate is substantially rectangular.

The method may include disposing at least one fastener between the top plate and the bottom plate, thereby securing the pedal housing (block 606). A fastener may include a standoff configured to provide a space between the first plate and the second plate. The pedal may be disposed between the first plate and the second plate.

The method may include disposing the musical effect component housing on a set of engagement rails of a pedalboard (block 608). The musical effect component housing may be disposed within a cavity formed in the pedalboard. A set of engagement rails may be engaged to a surface of the pedalboard, and the pedal housing may be secured to the pedalboard by a set of securement posts.

In some embodiments, a method for engaging a musical effect component housing to a pedalboard includes engaging a first plate of the musical effect component housing to a second plate via a series of fasteners. The first plate can form an aperture therein configured to expose a portion of a musical effect component. The second plate can be disposed subjacent to the first plate, wherein a musical effect component is configured to be disposed between the first plate and the second plate. The musical effect component can include a pedal as described herein. The method can also include disposing the first plate of the musical effect component housing to a set of engagement rails of frame portions of the pedalboard. The first plate and the second plate can be configured to be disposed within a cavity formed between the frame portions of the pedalboard frame.

In some embodiments, the first plate of the musical effect component housing is engaged to the set of engagement rails of frame portions of the pedalboard via a set of securement posts (e.g., thumb screws) on the first plate of the musical effect component housing.

In some embodiments, the method includes engaging a set of bumpers to the series of fasteners. Each bumper can be configured to engage with a portion of the musical effect component.

In some embodiments, the method includes disposing a musical effect component between the first plate and the second plate of the musical effect component housing. At least one input/output component of the musical effect component (e.g., a display, a switch, button) may be exposed from the aperture formed in the first plate.

In some embodiments, the method includes disposing a series of musical effect component housings along the engagement rails on the frame portions of the pedalboard frame such that each musical effect component housing is located adjacent to one another.

Remarks

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or" in reference to a list of two or more items covers all of the following interpretations of the word: any of the items in the list, all of the items in the list, and any combination of the items in the list.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

The above Detailed Description of examples of the invention is not intended to be exhaustive or to limit the invention to the precise form disclosed above. While specific examples for the invention are described above for illustrative purposes, various equivalent modifications are possible within the scope of the invention, as those skilled in the relevant art will recognize. For example, while processes or blocks are presented in a given order, alternative implementations may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed or implemented in parallel or may be performed at different times. Further any specific numbers noted herein are only examples: alternative implementations may employ differing values or ranges.

The teachings of the invention provided herein can be applied to other systems, not necessarily the system described above. The elements and acts of the various examples described above can be combined to provide further implementations of the invention. Some alternative implementations of the invention may include not only additional elements to those implementations noted above, but also may include fewer elements.

These and other changes can be made to the invention in light of the above Detailed Description. While the above description describes certain examples of the invention, and describes the best mode contemplated, no matter how detailed the above appears in text, the invention can be practiced in many ways. Details of the system may vary considerably in its specific implementation, while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific examples disclosed in the specification, unless the above Detailed Description section explicitly defines such terms. Accordingly, the actual scope of the invention encompasses not only the disclosed examples, but also all equivalent ways of practicing or implementing the invention under the claims.

What is claimed is:

1. A pedalboard to house at least one musical effect component, the pedalboard comprising:

a pedalboard frame including:

at least two frame portions, each of the at least two frame portions including an engagement rail, the pedalboard frame forming a cavity between the at least two frame portions; and a musical effect component housing configured to accommodate varying sized musical effect components, the musical effect component housing including:

a first plate forming an aperture therein configured to expose a portion of a musical effect component, wherein the first plate is configured to engage to the engagement rails of the at least two frame portions of the pedalboard frame;

a second plate that is disposed subjacent to the first plate, wherein the musical effect component is configured to be disposed between the first plate and the second plate; and a series of fasteners extending between the first plate and the second plate to connect the first plate and the second plate, the first plate and the second plate configured to be disposed within the cavity between the at least two frame portions formed in the pedalboard frame, wherein the musical effect component housing is configured such that a distance between the first plate and the second plate is modifiable based on a length of the series of fasteners such that the musical effect component housing can accommodate musical effect components of varying sizes.

2. The pedalboard of claim 1, wherein the first plate includes a length and a width that is greater than a length and a width of the second plate.

3. The pedalboard of claim 1, wherein the at least two frame portions include a first frame portion and a second frame portion, the first frame portion including a length less than a length of the second frame portion, wherein the musical effect component housing is disposed on the pedalboard frame at an angle based on the lengths of the at least two frame portions.

4. The pedalboard of claim 1, further comprising:

a set of bumpers disposed around each of the series of fasteners, each bumper configured to engage with a portion of the musical effect component.

5. The pedalboard of claim 1, further comprising:

a series of musical effect component housings disposed along the engagement rails on the at least two frame portions of the pedalboard frame, each of the series of musical effect component housings disposed adjacent to one another.

6. The pedalboard of claim 1, further comprising:

four securement posts disposed on a separate corner of the first plate, each securement post fastening a portion of the first plate to the engagement rails.

7. The pedalboard of claim 1, wherein the series of fasteners include varying lengths to accommodate securing varying sized musical effect components between the first plate and the second plate.

8. A musical effect component housing comprising:

a first plate forming an aperture therein that is configured to expose a portion of a musical effect component;

a second plate configured to be disposed subjacent to the first plate, wherein the musical effect component is configured to be disposed between the first plate and the second plate; and a series of fasteners extending between the first plate and the second plate to connect the first plate and the second plate, the first plate and the second plate connected via the series of fasteners, wherein the musical effect component housing is configured such that a distance between the first plate and the second plate is modifiable based on a length of the series of fasteners such that the musical effect component housing can accommodate musical effect components of varying sizes.

9. The musical effect component housing of claim 8, wherein the first plate is engaged to an engagement rail disposed along frame portions of a pedalboard frame, the musical effect component housing configured to be disposed within a cavity formed in the pedalboard frame.

10. The musical effect component housing of claim 9, wherein the frame portions include a first frame portion and a second frame portion, the first frame portion including a length less than a length of the second frame portion, wherein the musical effect component housing is disposed on the pedalboard frame at an angle based on the lengths of the at least two frame portions.

11. The musical effect component housing of claim 9, wherein a series of musical effect component housings are configured to be disposed along the engagement rails on the at least two frame portions of the pedalboard frame.

12. The musical effect component housing of claim 9, further comprising:

four securement posts disposed on a separate corner of the first plate, each securement post fastening a portion of the first plate to the engagement rails.

13. The musical effect component housing of claim 8, wherein the first plate includes a length and a width that is greater than a length and a width of the second plate.

14. The musical effect component housing of claim 8, further comprising:

a set of bumpers disposed around each of the series of fasteners, each bumper configured to engage with a portion of the musical effect component.

15. The musical effect component housing of claim 8, wherein the series of fasteners include varying lengths to accommodate securing varying sized musical effect components between the first plate and the second plate.

16. A method for engaging a musical effect component housing to a pedalboard, the method comprising:

engaging a first plate of the musical effect component housing to a second plate via a series of fasteners, the first plate forming an aperture therein configured to expose a portion of a musical effect component, the second plate disposed subjacent to the first plate, wherein the musical effect component is configured to be disposed between the first plate and the second plate, and wherein a distance between the first plate and the second plate is modifiable based on a length of the series of fasteners such that the musical effect component housing can accommodate musical effect components of varying sizes; and disposing the first plate of the musical effect component housing to a set of engagement rails of frame portions of the pedalboard, the first plate and the second plate configured to be disposed within a cavity formed between the frame portions of the pedalboard.

17. The method of claim 16, wherein the first plate of the musical effect component housing is disposed to the set of engagement rails of frame portions of the pedalboard via a set of securement posts disposed on the first plate of the musical effect component housing.

18. The method of claim 16, further comprising:

engaging a set of bumpers to the series of fasteners, each bumper configured to engage with a portion of the musical effect component.

19. The method of claim 16, further comprising:

disposing the musical effect component between the first plate and the second plate of the musical effect component housing, wherein at least one input/output component of the musical effect component is exposed from the aperture formed in the first plate.

20. The method of claim 16, further comprising:

disposing a series of musical effect component housings along the engagement rails on the frame portions of the pedalboard such that each musical effect component housing is disposed adjacent to one another.

* * * * *